US005827002A

United States Patent [19]

Nakajima

[11] Patent Number: 5,827,002

[45] Date of Patent: Oct. 27, 1998

[54] LIQUID APPLICATOR

[75] Inventor: Nobuyuki Nakajima, Takasaki, Japan

[73] Assignee: Mitsubishi Pencil Kabushiki Kaisha, Tokyo, Japan

[21] Appl. No.: 929,344

[22] Filed: Aug. 28, 1997

[30] Foreign Application Priority Data

Sep. 9, 1996 [JP] Japan ..... 8-238088

[51] Int. Cl.[6] ..... A46B 11/02

[52] U.S. Cl. ..... 401/174; 401/176; 401/172; 401/171

[58] Field of Search ..... 401/109, 110, 401/111, 171, 172, 174, 176, 179, 180

[56] References Cited

FOREIGN PATENT DOCUMENTS 2623426 5/1989 France ..... 401/174

*Primary Examiner*—Robert M. Fetsuga
*Assistant Examiner*—Tuan N. Nguyen
*Attorney, Agent, or Firm*—Darby & Darby

[57] ABSTRACT

A liquid applicator includes: an applicator portion provided at the front end of a barrel; a barrel joint having an approximately cylindrical shape, fitted into the rear of the barrel; and a pushing mechanism having a piston for pushing the liquid, accommodated inside the barrel joint. In this pushing mechanism, as a rotary handle is turned, a threaded shaft together with a delivering member rotates so as to move itself forwards by means of screw engagement with a threaded piece fixed to the barrel joint and thereby move the piston in the same direction. A liquid contained in front of the piston is delivered toward the applicator portion, thus the applicator portion is impregnated with the liquid.

5 Claims, 11 Drawing Sheets

LIQUID APPLICATOR

BACKGROUND OF THE INVENTION (1) Field of the Invention

The present invention relates to a liquid applicator for applying a liquid, in particular to a liquid applicator which is suitable for application of a liquid cosmetic such as liquid lip coloring, foundation, concealer, shadow coloring, etc.

(2) Description of the Related Art

The present inventor hereof already proposed a liquid applicator in Japanese Patent Application Hei 8 No. 141, 893, filed on Jun. 4, 1996, wherein a liquid cosmetic or the like is stored in a barrel and a rotary handle provided at the rear end of the barrel is rotated so as to move a piston provided in the barrel, to thereby push the liquid cosmetic forwards and impregnate the applicator portion at the front end of the barrel so that the liquid cosmetic can be applied from the applicator portion onto a certain object (for the United States, this has been filed as U.S. Ser. No. 08/792,842 (Feb. 3, 1997)).

FIGS. 1 through FIGS. 3A and 3B, are views showing this applicator. In the figures, 'a' designates a barrel. Attached to the front end of this barrel 'a' is a holder cylinder 'c' with a pipe 'b' fixed thereto, while a brush-like applicator portion 'd' covering the outer periphery of pipe 'b' is fixed by a mouthpiece e.

The rear half of barrel 'a' has a pushing mechanism 'g' for pressing a piston 'f' forwards, accommodated therein. In this pushing mechanism g, a rotary handle 'h' is fitted to the rear end of barrel 'a'. As this rotary handle 'h' is rotated in a particular direction, a delivering portion 'i' turns integrally therewith so as to rotate a threaded shaft 'j' passing therethrough.

This threaded shaft 'j' can move in the axial direction with respect to delivering portion 'i' and is engaged with a threaded piece 'k' fixedly fitted into the interior of barrel 'a'. When threaded is shaft 'j' rotated, it moves forwards by the screw engagement with threaded piece 'k', so as to push piston 'f' forwards, which in turn pushes the liquid contained in the front part forwards. The thus squeezed liquid reaches an applicator portion 'd' through pipe 'b' so as to impregnate applicator portion 'd', from which the liquid will be applied to a particular object. Here, in the figures, 'h' designates a cap covering mouthpiece 'e' and applicator portion 'd'.

In this way, in the applicator, as rotary handle 'h' is rotated, piston 'f' can be moved finely, so that it is possible to eject the cosmetic liquid at a small amount at a time, and hence it is possible to supply a correct amount of liquid which is required.

Concerning the applicators stated above, the amount of liquid to be stored in barrel 'a' often differs depending upon the utility of the applicator or the type of the liquid, and hence there are many cases where the inside diameter of the barrel should be changed in accordance with the amount to be filled.

However, since, in the above applicator, many components constituting the pushing mechanism 'g' are adapted to directly fit on the interior surface of barrel 'a', if the inside diameter of barrel 'a' needs to be changed by the requirement of change in the amount of liquid as stated above, all the parts to be fitted in the interior surface of barrel 'a' have to have their configurations changed, requiring more cost. Such being the case, it is impossible to deal fully with the demands for change in the inner diameter of the barrel.

Further, since, concerning the applicators stated above, threaded piece 'k' and rotary handle 'h' are press-fitted and fixed inside barrel 'a', barrel 'a' is expanded, warped or deformed when they are squeezed thereinto, causing a problem of markedly degrading the appearance.

Illustratively, in the above applicator, as shown in FIG. 2, a projection 'm' is formed on the interior surface of barrel 'a', and threaded piece 'k' and rotary handle 'h' are squeezed so as to pass over the projection, thus preventing them from slipping out from the press-fitted position in barrel 'a'. This projection 'm' has a curved cross-section as shown in FIG. 3A or a trapeziform cross section as shown in FIG. 3B. The case of a trapeziform projection 'm', the slanted faces m1 are adapted to intersect the top face m2 at an angle of 10 to 25 degrees.

Because of the above setting, the projected amount or the height of the inward projection 'm' needs to be set rather high in order to adequately prevent the parts from slipping off. However, in the case where a projection 'm' with a greater height is integrally formed with the barrel, the shape of the projection is liable to be deformed when the inserted core pin is forcibly stripped out. As a result, the nominally projected height produced by the die cannot be obtained in the finished molding. Further, contraction in the resin after molding, causes sink marks on the surface of the barrel 'a', presenting poor smoothness on the exterior surface and hence degrading the appearance of the product.

Further, when the projected height of the projection 'm' is set greater, barrel 'a' will be greatly pushed and extended radially outwards when threaded piece 'k' and rotary handle 'h' are squeezed thereinto. As a result, the cylinder surface might crack and hence the appearance might be degraded. The thus caused crack may grow to split barrel 'a', imparting adverse effects on the durability and life of the barrel. In particular, in the case where barrel 'a' is previously subjected to transfer printing or UV paint application, the surface may become stretched and cleaved, foggy etc., when the barrel surface is extended excessively due to the press-fitting of the parts, the degradation of the appearance becomes more acute.

SUMMARY OF THE INVENTION

The present invention has been devised in view of the above problems of the conventional applicators, and it is therefore an object of the present invention to provide a liquid applicator which can minimize the modification of the configuration of the pushing device even when the inside diameter of the barrel is variously changed in accordance with the amount of liquid to be filled inside the barrel.

It is another object of the invention to provide a liquid applicator which can insert the barrel joint without deteriorating the appearance of the product and can reliably prevent the barrel joint from slipping off after insertion.

In order to attain the above objects of the invention, the present invention is configured as follows:

In accordance with the first aspect of the invention, a liquid applicator includes:

an applicator portion attached to the front end of a barrel;

a piston fitted in the barrel so as to be able to slide in the axial direction whilst maintaining liquid hermetic contact with the barrel; and a pushing means for pushing the piston toward the applicator portion so as to send the liquid stored between the piston and applicator portion to the applicator portion, wherein the pushing means comprises:

a barrel joint fixed in the rear interior of the barrel so that it cannot move in both the rotary and axial directions;

a threaded portion having a threaded bore in the center thereof and fixed in the interior surface of the barrel joint so that it cannot move in both the rotary and axial directions;

a threaded shaft screw-fitted through the threaded bore of the screw piece and having a front end projected forwards from the barrel joint, joined to the center of the piston;

a delivering member of a cylindrical shape, loosely inserted through the barrel joint in the rear of the threaded piece, having a hollow which allows the threaded shaft to pass therethrough movably in the axial direction and rotating integrally with the threaded shaft;

a cam part of a serrated shape, formed at one end of the delivering member;

a cylindrical spring receiver fitted inside the barrel joint in such a manner that it can move in the axial direction but cannot move in the rotational direction;

a rotary handle fitted in the rear interior of the barrel joint in such a manner that it cannot move in the axial direction and can move in the rotational direction while it can move in both the axial and rotational directions with respect to the threaded shaft; and a ratchet mechanism for allowing the delivering member to rotate in only a particular rotational direction, the ratchet mechanism composed of a pair of serrated cam surfaces which are provided for the spring receiver and the delivering member on their opposing faces so as to be able to become engaged and disengaged with each other and a spring which urges the cam surface of the spring receiver against the cam surface of the delivering member, and the liquid applicator is characterized in that as the delivering member and the threaded shaft are rotated together with the rotary handle in a particular rotational direction, the threaded shaft moves forwards in the axial direction so as to push the piston toward the applicator portion.

In accordance with the second aspect of the invention, a liquid applicator having the above first feature, is characterized in that the barrel has a projection having a trapeziform cross-section along the circumferential direction and a projection along the longitudinal direction, both formed on the rear interior surface thereof while the barrel joint has a projection engaging the projection extending along the circumferential direction of the barrel and a recessed portion mating the projection extending along the longitudinal direction of the barrel, both formed on the outer peripheral surface thereof, and the angle formed between the front slanted side and the base side in the cross-sectional shape of the projection formed along the circumferential direction of the barrel, is set at 30° to 60° while the angle formed between the rear slanted side and the base side in the cross-sectional shape of the projection formed along the circumferential direction of the barrel joint is set at 75° to 90°.

In accordance with the third aspect of the invention, a liquid applicator having the above second feature is characterized in that the barrel has a projection having a trapeziform cross-section along the circumferential direction and a projection along the longitudinal direction, both formed on the rear interior surface thereof while the barrel joint has a projection engaging the projection extending along the circumferential direction of the barrel and a recessed portion mating the projection extending along the longitudinal direction of the barrel, both formed on the outer peripheral surface thereof, and the front corner at the base of the projection formed along the circumferential direction of the barrel has a curved surface having a radius of curvature of 0.05 to 0.2 mm while the base side on the interior side of the cross-sectional shape of the projection has a length equal to or greater than three times the height of the projection and the height is limited to within the range of 0.3 to 1.2% of the inside diameter of the barrel.

In accordance with the fourth aspect of the invention, a liquid applicator having the above second feature is characterized in that a plurality of the projections and the recessed portions are provided.

In accordance with the fifth aspect of the invention, a liquid applicator having the above third feature is characterized in that a plurality of the projections and the recessed portions are provided.

In the invention having the above first feature, since the pushing mechanism is accommodated inside the barrel joint, the modification of the inside diameter of the barrel, required when the stored amount of liquid, etc. is to be changed, can be made by only changing the outside diameter of the barrel joint, without needing any other modifications of other components. Therefore, it is possible to deal with the modification of the inside diameter of the barrel with a minimum increase in cost.

In accordance with the invention having the above second feature, when the angle of each slanted surface of the projection having a trapeziform cross-section is set as sated above, it is possible to reliably prevent the barrel joint after being fitted, from slipping off. Therefore, the projection does not need a very large projected height. As a result, after molding of the barrel, no sink marks occur on the surface, thus making it possible to obtain products having a smooth surface. The projected height of the projection is preferably set at a ratio relative to the base of the projection, defined in the above third aspect of the invention. Further, when a plurality of the projections and recessed portions are provided as defined in the fourth and fifth aspects of the invention, it is possible to enhance the fitting strength between the barrel and the barrel joint.

DESCRIPTION OF THE PREFERRED EMBODIMENTS

The embodiments of the invention will hereinafter be described in detail with reference to FIGS. 4A–4B through FIGS. 10A–10C.

Figure 1:
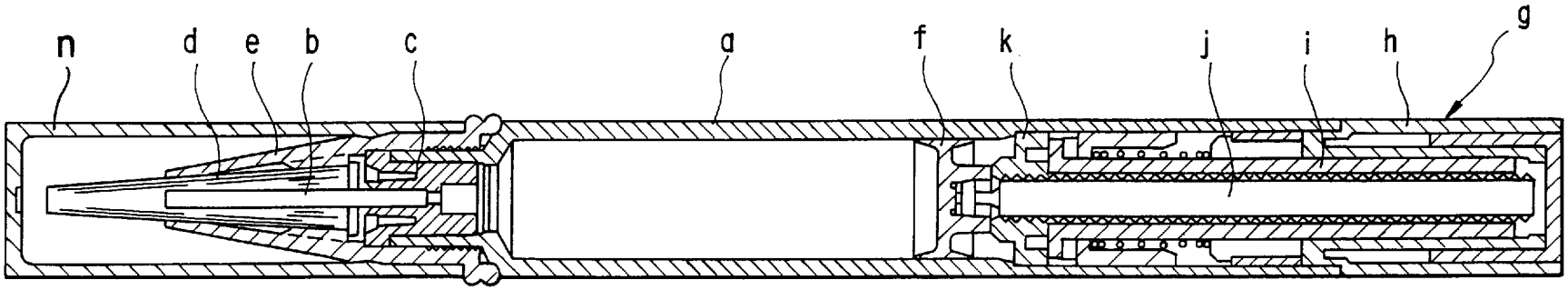
FIG. 1 PRIOR ART
FIG. 1 is a vertical section showing a prior art before the improvement of the invention.
Figure 2:
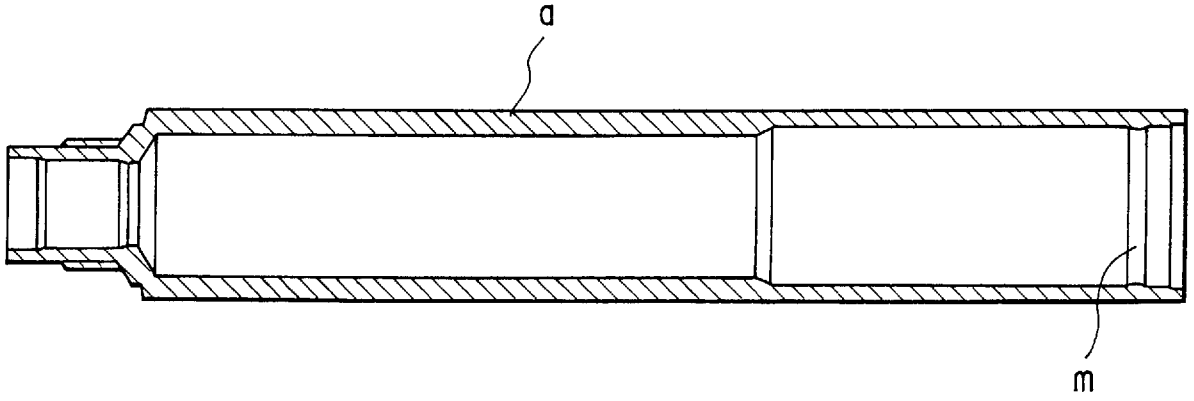
FIG. 2 PRIOR ART
FIG. 2 is a vertical section showing the barrel shown in FIG. 1.
Figure 3B:
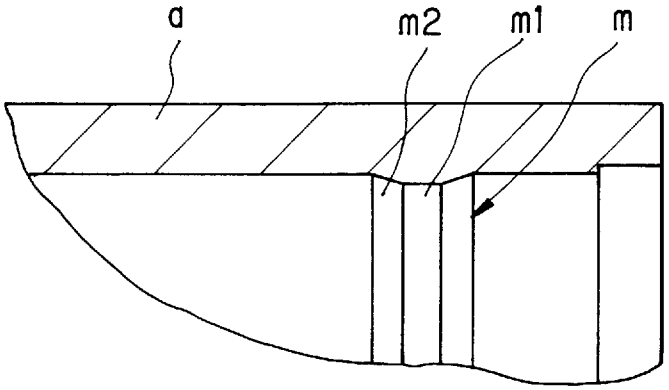
FIG. 3B PRIOR ART
FIGS. 3A and 3B are enlarged side views showing shapes of the projection shown in FIG. 2, FIGS. 3A and 3B showing an arc shaped projection and a trapeziform projection, respectively.
Figure 3A:
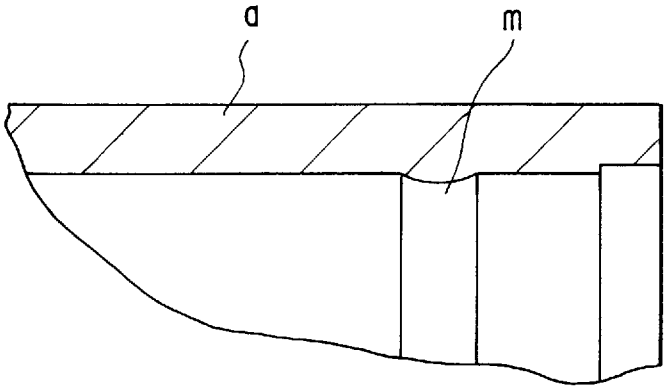
FIG. 3A PRIOR ART
Figure 4A:
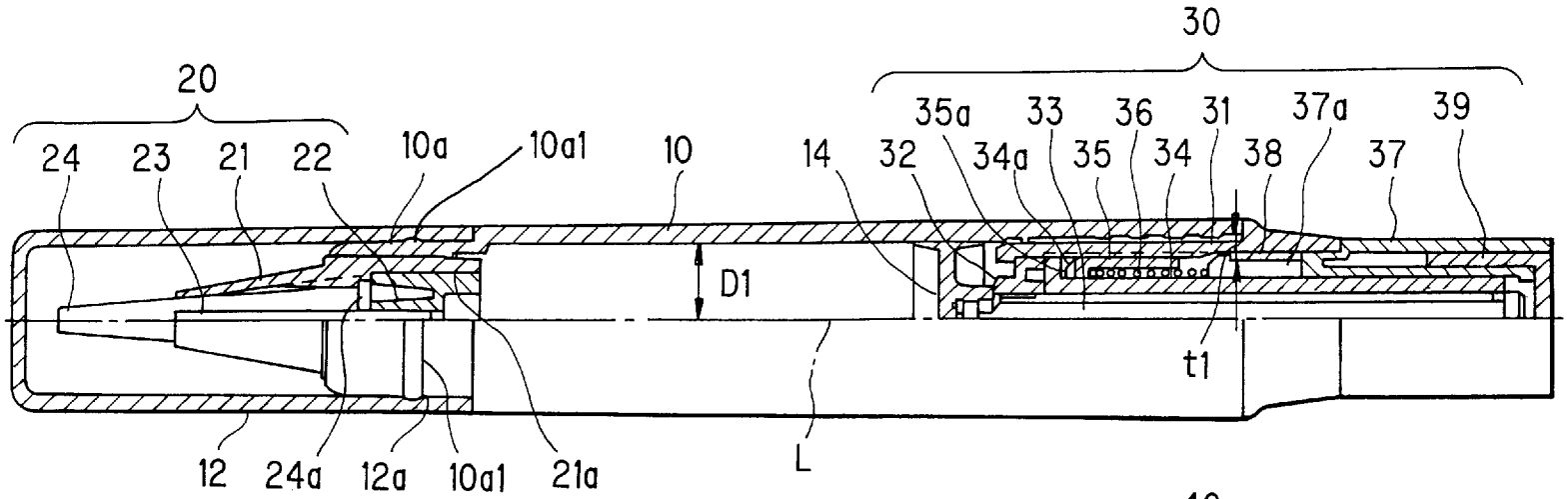
FIGS. 4A and 4B are vertical sectional side view partially showing an overall configuration of the embodiment of the invention, showing cases where a small-diametric barrel is used and where a large-diametric barrel is used, respectively.
Figure 4B:
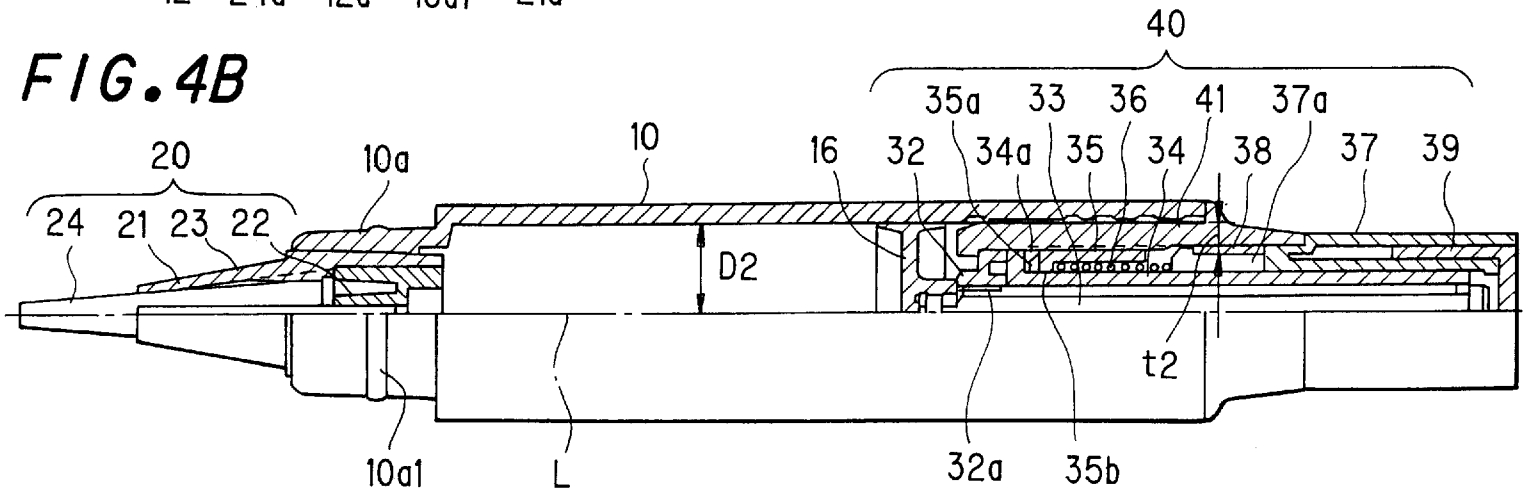
Figure 5:
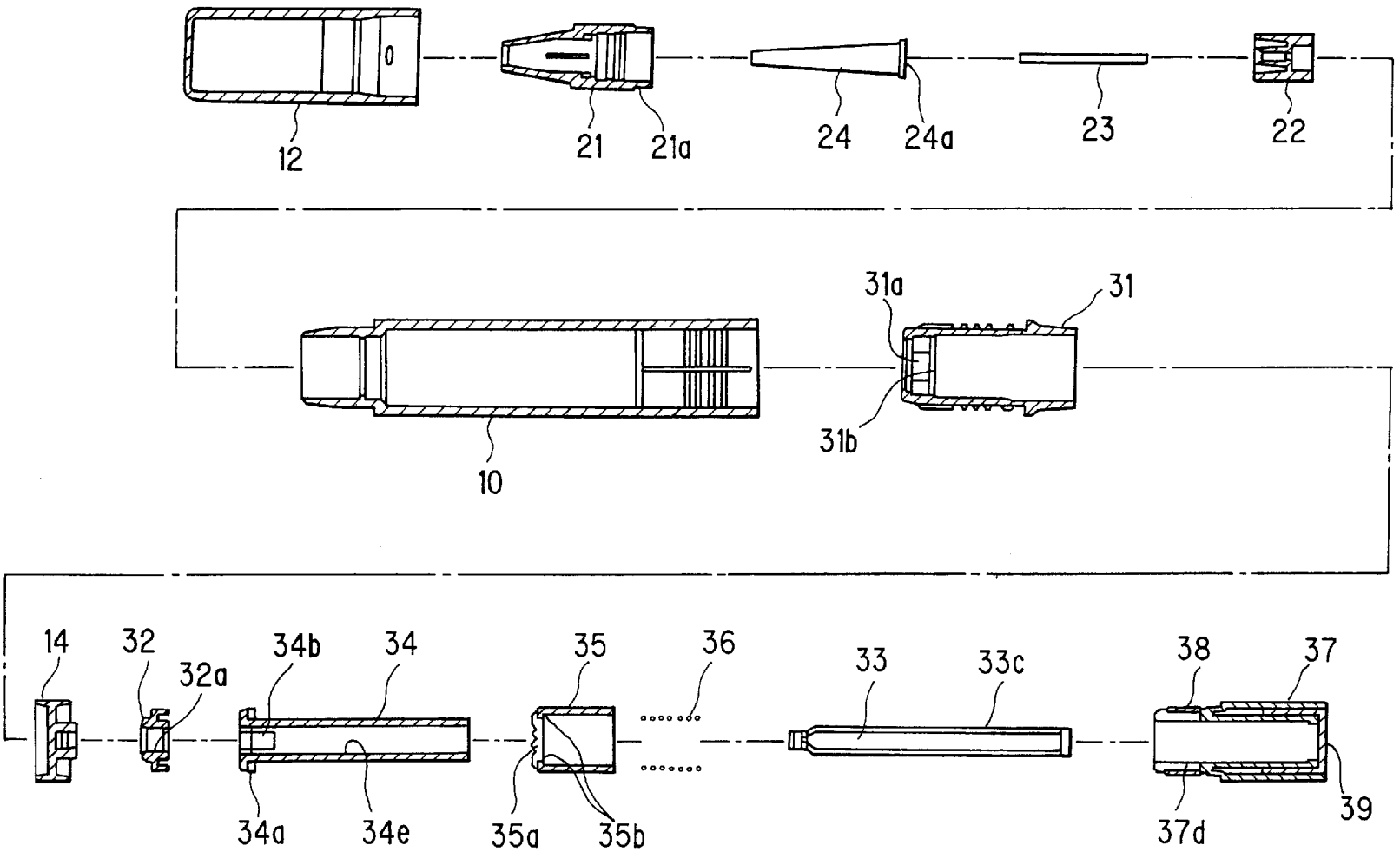
FIG. 5 is an exploded sectional side view of that shown in FIGS. 4A and 4B.
Figure 6:
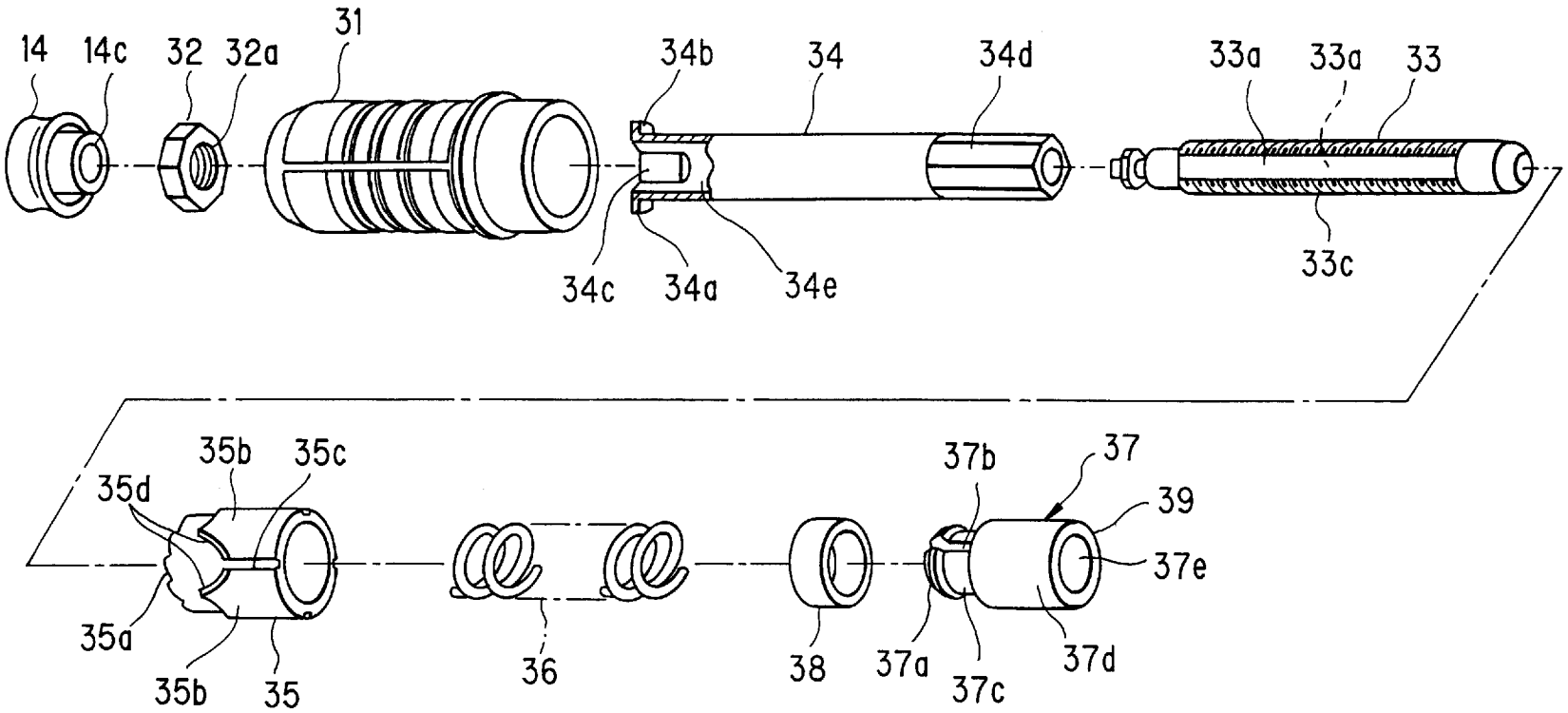
FIG. 6 is a perspective view showing the components shown in FIG. 5.
Figure 7:
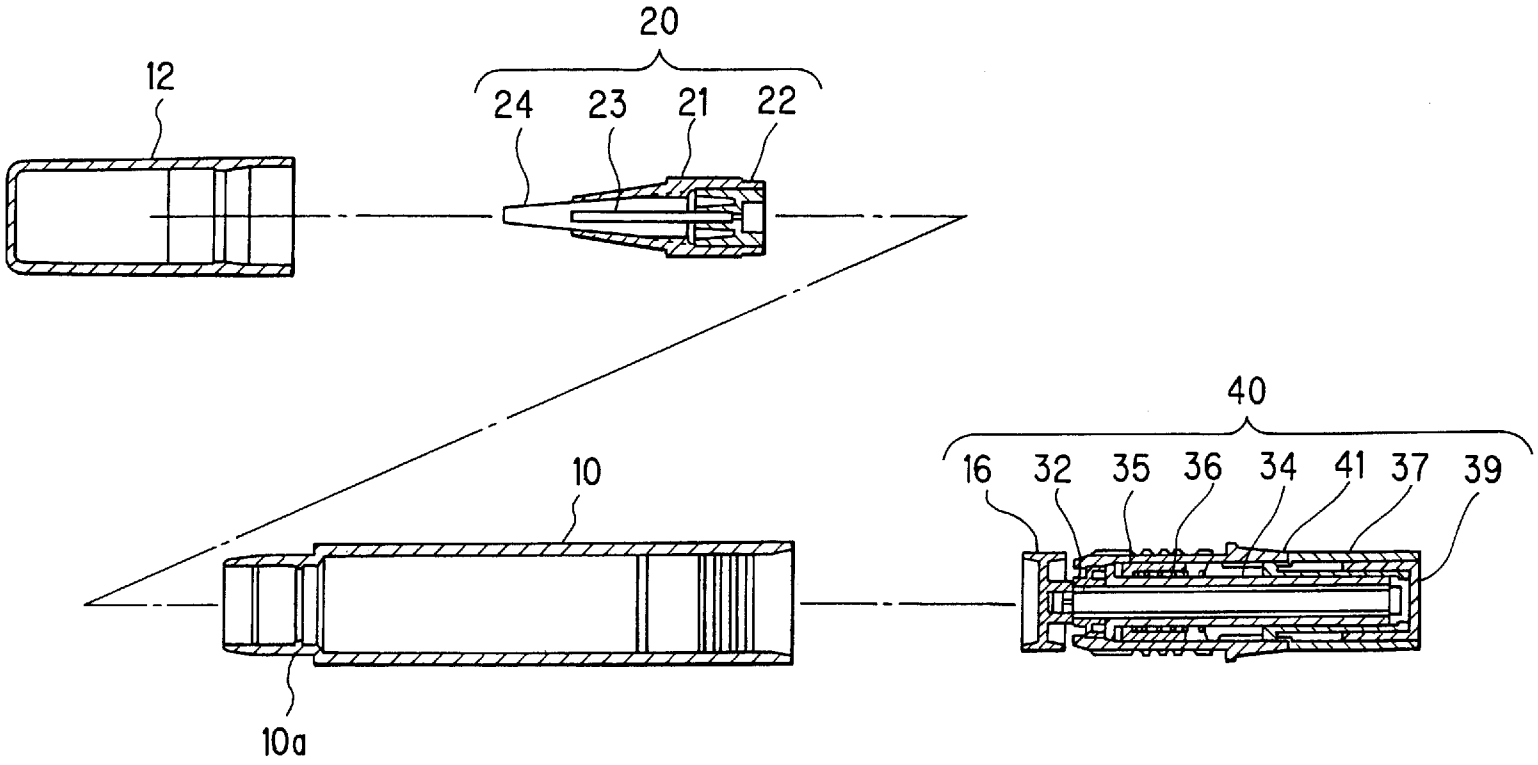
FIG. 7 is an exploded sectional view showing that shown in FIG. 5 wherein the applicator portion and pushing mechanism are assembled.
Figure 8:
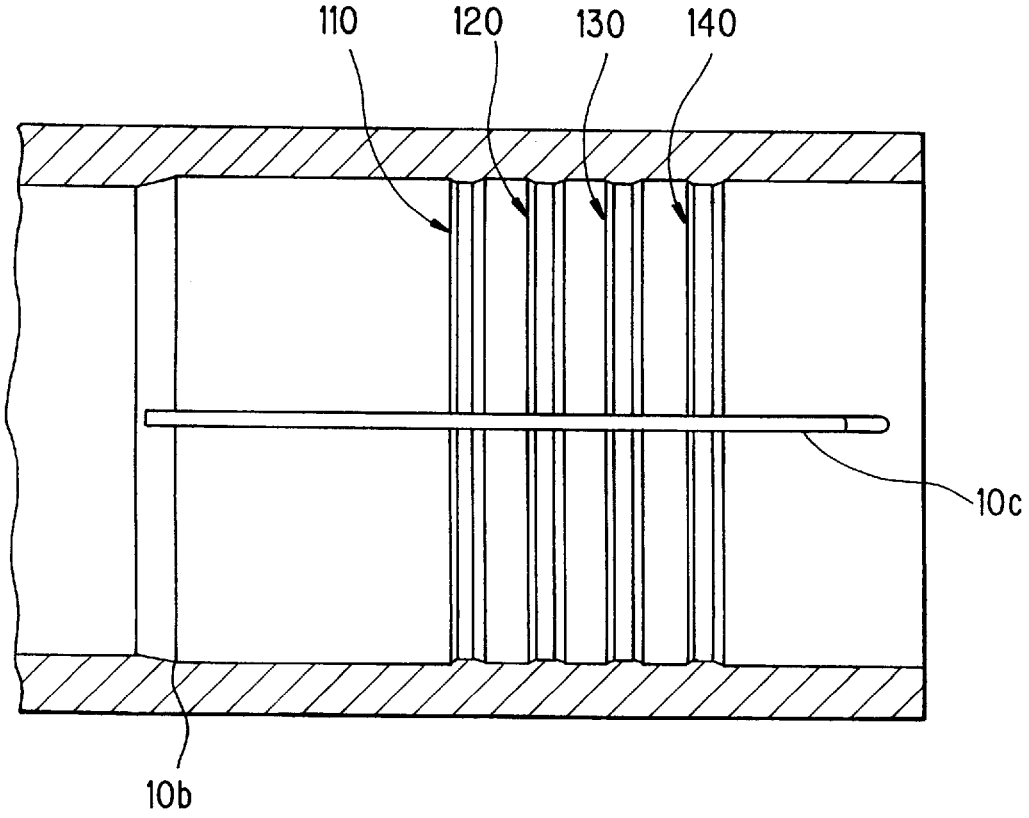
FIG. 8 is an enlarged vertical sectional side view showing the rear part of the barrel shown in FIG. 6.
Figure 9:
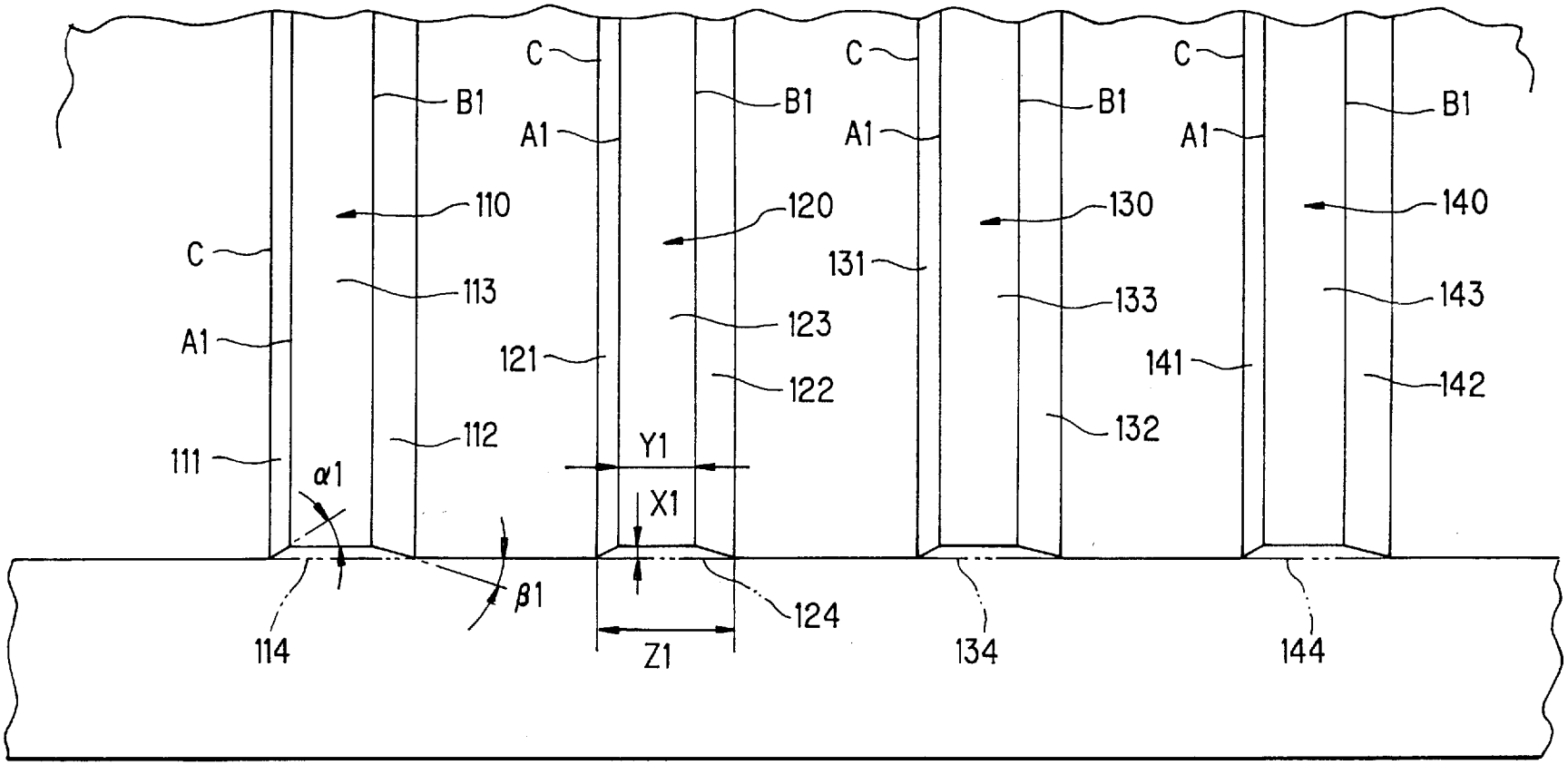
FIG. 9 is an enlarged vertical sectional side view showing the arrangement of the projections shown in FIG. 7.
Figure 10A:
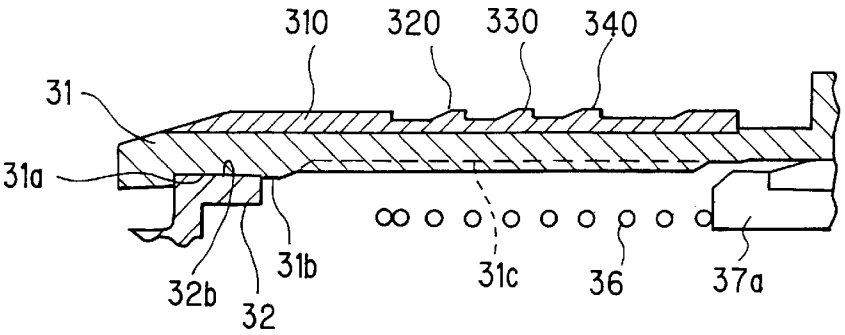
FIGS. 10A to 10C are illustrative vertical sectional views showing the sectional shape of the projections and recessed portion of the barrel shown in FIG. 5.
Figure 10C:
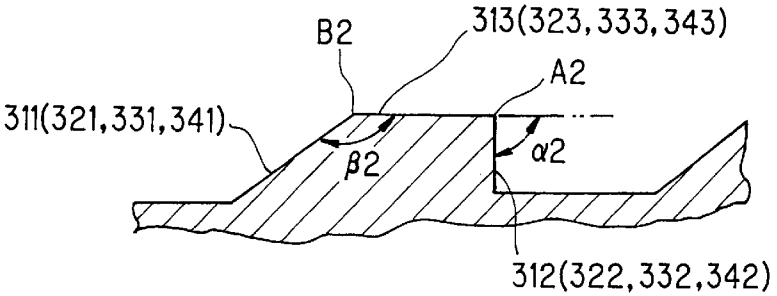
Figure 10B:
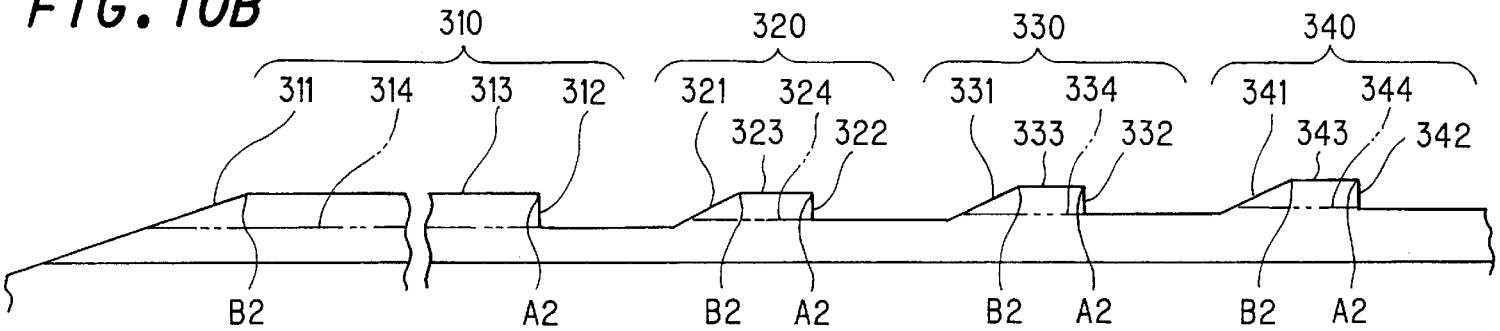

FIGS. 4A and 4B are partial vertical sections showing overall configurations of the first embodiment of the invention. FIG. 4A shows a case where a small-diametric barrel is used and FIG. 4B shows a case where a large-diametric cylinder is used. FIG. 5 is an exploded sectional view showing those shown in FIGS. 4A and 4B. FIG. 6 is a perspective view of FIG. 5. FIG. 7 is an exploded sectional view showing that shown in FIG. 5 wherein the applicator portion FIG. 8 pushing mechanism are assembled. FIG. 8 is an enlarged vertical sectional side view showing the rear part of the barrel shown in FIG. 6. FIG. 9 is an enlarged vertical sectional side view showing the arrangement of projections shown in FIG. 7. FIGS. 10A to 10C are illustrative vertical sectional views showing the sectional configuration of the projections of the barrel shown in FIG. 5.

The applicator of this embodiment has an axisymmetric shape with respect to a center line L as shown in FIGS. 4A and 4B, and comprises a barrel 10 having a cylindrical shape as a middle part, an applicator portion 20 attached to the front end of barrel 10 and a pushing mechanism 30 for pushing the application liquid (e.g. a liquid cosmetic) stored inside the barrel 10 toward applicator portion 20.

Barrel 10 is approximately formed of a cylindrical shape and has a small-diametric portion 10*a* at the front end thereof. The interior of this small-diametric portion 10*a* is formed so that an aftermentioned mouth piece 21 for applicator portion 20 will be fitted thereto. The outer peripheral surface of small-diametric portion 10*a* is formed so that a cap 12 for covering over applicator portion 20 can be removably fitted thereto. Formed on the outer peripheral surface of small-diametric portion 10*a* is an annular engaging step 10*a*1 which gradually projects outwards along its length. Cap 12 has a plurality of projections 12*a* formed on the inner surface thereof. When the cap is attached to the barrel, these projections 12*a* pass over engaging step 10*a*1 and fit into place, thus making it possible to maintain the fitted state of cap 12.

Fixedly fitted to the front end of barrel 10 is an applicator portion 20. This applicator portion 20 comprises a mouth piece 21 which is fixedly fitted into the interior of the small-diametric portion 10*a* of barrel 10, a holder cylinder 22 fitting into the interior of the rear half of mouth piece 21, a pipe 23 with one end press fitted into the center of holder cylinder 22, and a brush 24 surrounding pipe 23 as its core and inserted into the front half of mouth piece 21. This brush 24 is bound at its rear end 24*a* by thermal fusing and the bound portion is engaged with the middle portion of the mouth piece in an unremovable manner, and the front part of the brush is projected out from the front opening of mouth piece 21.

When mouth piece 21 is fully squeezed into the interior of small-diametric portion 10*a* of barrel 10, an annular recess 21*a* formed on the outer peripheral surface of mouth piece 21 fits the annular projection formed on the interior surface of small-diametric portion 10*a* so as to prevent mouth piece 21 from falling off.

A piston 14 is fitted in the interior of barrel 10 so that it can slide whilst maintaining liquid hermetic contact. A pushing mechanism 30 for pushing piston 14 toward the applicator portion is provided at the rear of barrel 10.

This pushing mechanism 30 comprises an approximately cylindrical barrel joint 31 fitting into the rear interior of barrel 10 and a rotary handle 37 press fitted into the rear end of barrel joint 31, the two forming an overall frame. Accommodated inside barrel joint 31 are a threaded piece 32, a threaded shaft 33, a spring receiver 35, a delivering member 34, a spring receiver 35 and a spring 36.

Now, each part of pushing mechanism 30 will be described in detail.

Barrel joint 31 is press fitted to the rear interior of barrel 10 so that it cannot move in both the rotational direction and the axial direction. An engaging part 31*a* having multiple facets is formed on the front interior surface of barrel joint 31, and an annular projection 31*b* projecting radially inwards is also formed therein at the rear of engaging part 31*a*. Further, the interior surface of the barrel joint has four ribs 31*c* extending in the longitudinal direction formed equi-angularly in the circumferential direction (see FIG. 5 and FIG. 10A).

Threaded piece 32 has a threaded bore 32*a* in the center and has multiple facets on the outer side thereof forming a close-fit with the engaging facets formed in the front end of barrel joint 31. The attachment is implemented by inserting threaded piece 32 from the rear opening of barrel joint 31 and squeezing it so as to make the threaded piece pass over projection 31*b* formed on the interior surface of barrel joint 31. The threaded piece 32 having passed over projection 31*b* is fitted to barrel joint 31 in such a manner that the outer side having a polygonal configuration mates with engaging part 31*a* formed inside barrel joint 31. This engagement disenables threaded piece 32 to rotate with respect to barrel joint 31, and the motion of the threaded piece is prohibited by projection 31*b*.

Delivering member 34 has a tubular shape which can be loosely inserted into barrel joint 31 and has a flange 34*b* at its front end. Flange 34*b* is integrally formed on its rear side with a serrated cam part 34*a*. This delivering member 34 further has a pair of flat portions 34*c* facing one another, integrally formed in the interior in the front part thereof. Delivering member 34 has a rear exterior surface 34*d* made up of multiple facets.

Spring receiver 35 has a tubular shape which loosely holds delivering member 34 therein, and has an abutting face 35*b* formed at the front part which receives the front part of spring 36 fitting through delivering member 34. This spring receiver 35 has a serrated cam part 35*a* integrally formed at the front end thereof which projects forwards so as to detachably engage with cam part 34*a* of delivering member 34. That is, the spring receiver is urged constantly by the force of spring 36 so that cam part 35*a* engages the cam part 34*a*. The other end of spring 36 which at its one end abuts spring receiver 35, abuts a front end 37*a* of rotary handle 37 so that the spring is constantly kept in a compressed state. In this way, spring 36, cam parts 34*a*and 35*a* constitute a ratchet mechanism.

As shown in FIG. 6, formed on the outer peripheral side of spring receiver 35 are four thick-walled portions 35*b* having cusps on the front part thereof with engaging grooves 35*c*between neighboring thick-walled portions 35*b*. These engaging grooves 35*c* will engage ribs 31*c* on barrel joint 31 when spring receiver 35 is inserted into barrel joint 31, so that spring receiver 35 will not rotate. From each engaging groove 35*c*, a pair of slanted end surfaces 35*d* extend forwards in thick-walled portions 35*b*, as guide surfaces. These guide surfaces 35*d* guide ribs 31*c* of barrel joint 31 into engaging grooves 35*c* so that spring receiver 35 can be reliably inserted into a correct position in barrel joint 31.

Threaded shaft 33 is composed of a shaft portion with a pair of longitudinally extending flat faces 33*a*, 33*a* opposite to each other (and hence having a cross-section of ellipse-like shape), with thread grooves 33*c* on the curved faces. This shaft is inserted through hollow 34*e* of delivering member 34 in such a manner as to be able to move in the axial direction while the portion projected forward from delivering member 34 is screw-fitted into threaded bore 32*a* of threaded piece 32. Here, since threaded shaft 33 is placed with its two flat faces 33*a*, 33*a* in surface contact with the flat portions 34*c* of delivering member 34, it will not rotate inside delivering member 34 and hence will rotate integrally with delivering member 34. The front end of threaded shaft 33 projecting from threaded piece 32 is adapted to rotatably fit a fitting portion 14*c* of piston 14.

Formed in rotary handle 37 are a pair of front portions 37*a* divided by a slit 37*b*. This front portion 37*a* has a fitting groove 37*c* on which a fitting ring 38 rotatably fits in an unremovable manner. This fitting ring 38 is press fitted and fixed to the rear end of barrel joint 31. Accordingly, rotary handle 37 is held rotatably relative to barrel joint 31, by means of fitting ring 38. Formed on the inner surface of rotary handle 37 is a multi-facet portion 37*d* which will mate rear exterior surface 34*d* of delivering member 34. This multi-facet portion 37*d* is engaged with the rear part of delivering member 34 so that delivering member 34 rotates together with rotary handle 37. Here, 37*d* designates a cylindrical gripping portion of the rotary handle, and 37*e* designates a plug capping the opening of this gripping portion 37*d*.

Concerning resin materials forming barrel 10 and barrel joint 31, PP(polypropylene) or HDPE (high-density polyethylene) is preferably used for the barrel, especially for the projections, while the barrel joint is preferably formed of ABS or PBT which present high surface hardness. Forming of the barrel joint with a resin having a high surface hardness permits the angled portions of the projections in the barrel joint to closely engage the projections of barrel 10, thus providing a strong resistance against forces exerted on the barrel joint in a direction which would cause removal.

In the applicator thus configured, at the initial stage of use, piston 14 is located adjacently in front of threaded piece 32 while the liquid to be applied, such as liquid cosmetics, etc. is contained between piston 14 and brush 24.

As rotary handle 37 is rotated in a particular direction with respect to barrel 10, delivering member 34 turns together with rotary handle 37. Before this rotating operation, cam part 34*a* of delivering member 34 would have been engaged with cam part 35*a* of spring receiver 35 by the urging force of spring 36. However, when delivering member 34 receives rotating force in a particular direction by the rotating operation, cam part 34*a*, becomes separated from cam part 35*a* along the slanted surfaces 35*d* opposing the urging force from spring receiver 35, alternately being released from engagement with cam part 35*a* and becoming re-engaged with cam part 34*a*. Thus the cam part rotates whilst this alternate movement is repeated. Accordingly, during the rotating operation, a clicking feeling is sensed for every one step of movement when cam parts 34*a* and 35*a* become engaged with each other. In this way, the operator can sense the amount of rotary operation from the clicking feeling.

As delivering member 34 turns as stated above, threaded shaft 33 inserted therein also rotates together with rotary member 34. Since threaded shaft 33 is mating threaded piece 32 fixed in barrel joint 31, the shaft moves forwards as it rotates and pushes piston 14 because the front part of the shaft is fitted to the piston. By this operation, the liquid stored in barrel 10 is pushed from holder cylinder 22 through pipe 23 to be supplied to brush 24.

Thus, since in the applicator, the rotary motion of rotary handle 37 is converted into slight shift of piston 14, it is possible to minutely adjust the amount of ejection and hence it becomes possible to supply a correct amount of liquid to brush 24.

When rotary handle 37 is attempted to be rotated in the opposite direction, cam part 34*a* provided in delivering member 34 becomes engaged with cam part 35*a* provided in spring receiver 35, the rotation of delivering member 34 is prevented and hence the rotary handle 37 is prohibited from rotating.

For applicators of this type, when the amount of liquid stored in barrel 10 is changed, generally the inside diameter of barrel 10 is modified. In this implementation, however, modifying only the outside diameters of barrel joint 31 and piston 14 will do without needing other parts to be changed. Consequently, it is possible to markedly more easily deal with the change in inside diameter of barrel 10.

As an example, in the case where, to increase the reservoir's amount of liquid, barrel 10 having an inside dimension of D1 as shown in FIG. 4A is replaced by barrel 10 having an inside dimension of D2 as shown in FIG. 4B, a barrel joint 41 having a wall thickness of t2, which is increased by the increment in inside dimension, (D2−D1)/2, and a piston 16 having an enlarged diameter proportional to the increment may be used whilst other parts are used as before, to achieve the above object.

Accordingly, even when there are demands for change in the outside dimension of barrel 10 in connection with change in the reservoir's amount of liquid or the like, it is possible to readily deal with this demand with a minimum increase in cost.

Further, in this embodiment, the fixture between barrel 10 and barrel joint 31 is achieved by fitting projections 110 to 140 formed on the inner surface of barrel 10 with projections 310 to 340 formed on the external surface of barrel joint 31. Illustratively, as shown in FIG. 8, a plurality (four, in this example) of annular projections 110, 120, 130 and 140 are formed on the rear inner surface of barrel 10, while a pair of linearly extending projections 10*c* along the axial direction are provided at 180 degrees opposite each other. The cross sectional shapes of annular projections 110 to 140 are trapeziform as shown in FIG. 9. These trapeziform shapes are set as follows: The angle $\alpha 1$ for a corner Al formed between the front slanted surface 111, 121, 131 and 141 of each trapeziform shape and the corresponding base side 113, 123, 133 and 143 thereof is set between 30° to 60°. The angle $\beta 1$ for a corner b1 formed between the rear slanted surface 112, 122, 132 and 142 of each trapeziform shape and the corresponding base side 113, 123, 133 and 143 thereof is set between 5° and 30°. Further, the length Z1 of base side 114, 124, 134 and 144 on the inner side is set about ten times greater than the height X1 of the trapeziform shape, whereas the length Y1 of base side 113, 123, 133 and 143 on the other side is set as large as three times or more of the height X1.

In addition, these projections 110 to 140 are formed so that, assuming that diameter at base 113, 123, 133 and 143 is K1, K2, K3 and K4, these diameters are set greater in the order from that which is located on the inner side to that on the outer side. Specifically, K1<K2<K3<K4.

On the other hand, as shown in FIGS.10A to 10C, formed on the outer peripheral surface of barrel joint 31 are projections 310, 320, 330 and 340 engaging projections 110 to 140. Each projection 310 through 340 is trapeziform. For each trapeziform shape, the angle α2 for a corner A2 formed between the rear slanted surface 312, 322, 332 and 342 and the corresponding base side 313, 323, 333 and 343 is set between 90° to 75°. The angle β2 for a corner B2 formed between the front slanted surface 311, 321, 331 and 341 and the corresponding base side 313, 323, 333 and 343 is set between 175° and 140°. In addition, these projections 310 to 340 are formed so that, assuming that diameter at base 313, 323, 333 and 343 is D1, D2, D3 and D4, these diameters are set greater in the order from that which is located on the inner side to that on the outer side. Specifically, D1' 1 D2' 1 D3' 1 D4.

Since the projections as above are formed on the inner surface of barrel 10 and on the outer peripheral surface of barrel joint 31, it is possible to readily and reliably fix barrel joint 31 to barrel 10 by inserting barrel joint 31 into the opening of barrel 10.

Actually, when the barrel joint is inserted into barrel 10, each of projections 110, 120, 130 and 140 formed on barrel 10 comes in contact only with the corresponding one of projections 310, 320, 330 and 340 formed on barrel joint 31. When the barrel joint is inserted, matching projections immediately abut, explicitly, projection 110 is abutted against 310, projection 120 against 320, projection 130 against 330, and projection 140 against 340, and when barrel joint 31 is further pressed, from that abutment state, each projection on the barrel joint side simultaneously passes over the corresponding projection on barrel 10 creating engagement, so that the two parts become fixed smoothly by a single step operation.

Since the angle α2 of each corner A2 formed between the base side and the rear slanted side of projection 310, 320, 330 and 340 is formed at right angles (90' 0 ), each corner becomes meshed with corresponding projection 110, 120, 130 and 140 of barrel 10, thus forming a firm engagement.

Accordingly, it becomes possible to create a strong engagement between barrel 10 and barrel joint 31 even when each of the projections in barrel 10 and barrel joint 31 is not set very high. Thus, it is possible to produce a barrel 10 having a good appearance.

Since in the conventional applicators, the shoulder of the trapeziform cross-section of each projection was set at an obtuse angle, the height of the projection had to set at 1.2% or more of the inside diameter in order to obtain adequate engaging or anti-drawing strength. Therefore, the projections needed to be set large. When the projected amount was set large, this setting caused sink marks on the surface of barrel 10 during molding, thus markedly lowering the appearance of the product. In contrast, in this implementation, since barrel 10 and barrel joint 31 are engaged firmly by means of the projections, on both the sides, configured as stated above, it is possible to obtain products having good appearance without the necessity to provide projections having such a large projected amount.

As an example, in this embodiment, the height X1 of the trapeziform shape can be set at 1.2 to 0.3% of the inside diameter (KA, KB, KC, KD) across the top side (113, 123, 133, 143) of each projection. Therefore, after molding of barrel 10, the occurrence of sink marks on the surface thereof, can be markedly reduced, thus making it possible to obtain products having a smooth, good appearance.

Moreover, in this embodiment, the corner C at which base side 114, 124, 134, 144 and slanted side 111, 121, 131, 141 meet each other is formed so that its curvature radius is set at 0.05 to 0.2 mm. This setting prevents pieces from being scraped from the molding when the core pin is stripped during molding. Therefore, it becomes possible to easily create a perfect shape as designated, and no fiber-like shavings which occurred due to scraping arise. Thus, the conventional problems attributed to shaving waste will not occur such as degradation of liquid hermetic performance of the piston after assembly as well as damage to piston 14 and/or barrel 10 due to the entrance of the shaving waste between piston 14 and barrel 10. As a result, it is possible to provide a smooth sliding motion and a liquid squeezing function of piston 14.

Figure 11:
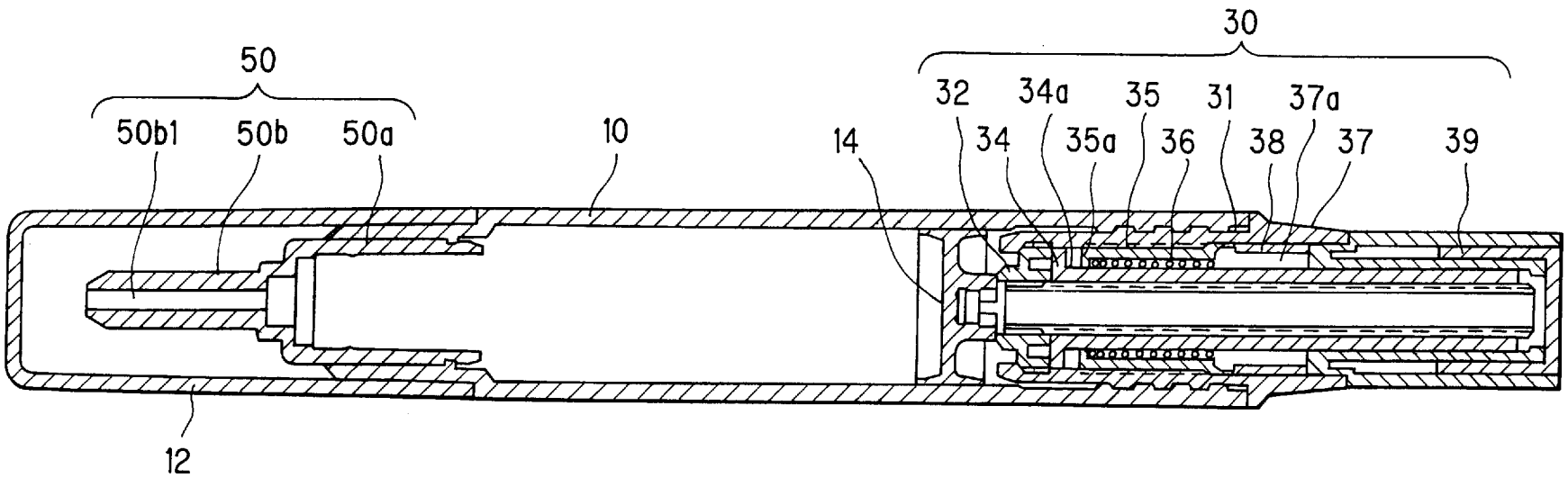
FIG. 11 is a vertical sectional side view showing the second embodiment of the invention.

In the description of the above embodiment, a brush formed of bound fibers was exemplified as the applicator portion, it is possible to fit a cylindrical member 50 made of resin or the like to the interior of front portion 10*a*of barrel 10 and use it as the applicator portion, as shown in the second embodiment in FIG. 11. This cylindrical member 50 is composed of a cylindrical portion 50*a*which fits the interior of barrel 10 and a small-diametric portion 50*b*having a smaller diameter than portion 50*a*. Small-diametric portion 50*b* has a liquid ejecting passage 50*b*1 at the core thereof formed in communication with the large-diametric portion. Therefore, liquid squeezed through piston 14 by pushing mechanism 30 having a similar structure to that in the first embodiment is ejected through the above liquid ejecting passage 50*b*1. Here, in this second embodiment, the same parts as those in the first embodiment are designated at the same reference numerals.

As has been described heretofore, in the liquid applicator in accordance with the invention, since the pushing mechanism for pushing the liquid stored in the barrel is accommodated inside the barrel joint, even the modification of the inside diameter of the barrel in association with the change of the reservoir's amount of liquid or other alternative can be implemented by only the change of the outside diameter of the barrel joint and the piston, without the necessity to change any other parts, thus making it possible to deal with the modification of the inside diameter of the barrel with a minimum increase in cost.

Further, when the angle formed between the front slanted surface and the base surface of the projection, having a trapeziform cross-section, which is formed in the barrel is set at an angle of 30° to 60° while the angle between the rear slanted surface and the base surface of the projection formed on the barrel joint is set at an angle of 75° to 90°, it is possible to reliably prevent the barrel joint after being fitted, from slipping off, without the necessity to provide projections which are high. Accordingly, after molding of the barrel, no sink marks occur on the surface, thus making it possible to obtain products having a smooth surface.

Further, when a plurality of projections are formed in the barrel and the barrel joint, it is possible to enhance the engagement between the barrel and the barrel joint more firmly.

What is claimed is:

1. A liquid applicator comprising:

an applicator portion attached to the front end of a barrel;

a piston fitted in the barrel so as to be able to slide in the axial direction whilst maintaining liquid hermetic contact with the barrel; and a pushing means for pushing the piston toward the applicator portion so as to send the liquid stored between the piston and applicator portion to the applicator portion, wherein the pushing means comprises:

a barrel joint fixed in the rear interior of the barrel so that it cannot move in both the rotary and axial directions;

a threaded piece having a threaded bore in the center thereof and fixed in the interior surface of the barrel joint so that it cannot move in both the rotary and axial directions;

a threaded shaft screw-fitted through the threaded bore of the screw piece and having a front end projected forwards from the barrel joint, joined to the center of the piston;

a delivering member of a cylindrical shape, loosely inserted through the barrel joint in the rear of the threaded piece, having a hollow which allows the threaded shaft to pass therethrough movably in the axial direction and rotating integrally with the threaded shaft;

a cam part of a serrated shape, formed at one end of the delivering member;

a cylindrical spring receiver fitted inside the barrel joint in such a manner that it can move in the axial direction but cannot move in the rotational direction;

a rotary handle fitted in the rear interior of the barrel joint in such a manner that it cannot move in the axial direction and can move in the rotational direction while it can move in both the axial and rotational directions with respect to the threaded shaft; and a ratchet mechanism for allowing the delivering member to rotate in only a particular rotational direction, the ratchet mechanism composed of a pair of serrated cam parts which are provided for the spring receiver and the delivering member on their opposing faces so as to be able to become engaged and disengaged with each other and a spring which urges the cam surface of the spring receiver against the cam surface of the delivering member, said liquid applicator being characterized in that as the delivering member and the threaded shaft are rotated together with the rotary handle in a particular rotational direction, the threaded shaft moves forwards in the axial direction so as to push the piston toward the applicator portion.

2. A liquid applicator according to claim 1, wherein the barrel has a projection having a trapeziform cross-section along the circumferential direction and a projection along the longitudinal direction, both formed on the rear interior surface thereof while the barrel joint has a projection engaging the projection extending along the circumferential direction of the barrel and a recessed portion mating theprojection extending along the longitudinal direction of the barrel, both formed on the outer peripheral surface thereof, and the angle formed between the front slanted side and the base side in the cross-sectional shape of the projection formed along the circumferential direction of the barrel, is set at 30° to 60° while the angle formed between the rear slanted side and the base side in the cross-sectional shape of the projection formed along the circumferential direction of the barrel joint is set at 75° to 90°.

3. A liquid applicator according to claim 2, wherein the front corner at the base of the projection formed along the circumferential direction of the barrel has a curved surface having a radius of curvature of 0.05 to 0.2 mm while the base side on the interior side of the cross-sectional shape of the projection has a length equal to or greater than three times the height of the projection and the height is limited to within the range of 0.3 to 1.2% of the inside diameter of the barrel.

4. A liquid applicator according to claim 3, wherein a plurality of the projections and the recessed portions are provided.

5. A liquid applicator according to claim 2, wherein a plurality of the projections and the recessed portions are provided.

* * * * *